US010474087B2

(12) United States Patent
Makino

(10) Patent No.: US 10,474,087 B2
(45) Date of Patent: Nov. 12, 2019

(54) IMAGE FORMING APPARATUS

(71) Applicant: Brother Kogyo Kabushiki Kaisha, Nagoya-shi, Aichi-ken (JP)

(72) Inventor: Masato Makino, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 64 days.

(21) Appl. No.: 15/716,689

(22) Filed: Sep. 27, 2017

(65) Prior Publication Data

US 2018/0088514 A1 Mar. 29, 2018

(30) Foreign Application Priority Data

Sep. 28, 2016 (JP) ..... 2016-189787

(51) Int. Cl.
*G03G 15/00* (2006.01)
*G03G 15/20* (2006.01)
(Continued)

(52) U.S. Cl.
CPC ..... *G03G 15/6573* (2013.01); *B65H 29/52* (2013.01); *B65H 31/26* (2013.01); *B65H 43/02* (2013.01); *B65H 85/00* (2013.01); *G03G 15/2035* (2013.01); *G03G 15/6552* (2013.01); *B65H 31/24* (2013.01); *B65H 2301/33312* (2013.01); *B65H 2301/5133* (2013.01); *B65H 2301/5305* (2013.01); *B65H 2401/115* (2013.01); *B65H 2404/533* (2013.01); *B65H 2404/61* (2013.01); *B65H 2404/63* (2013.01); *B65H 2404/693* (2013.01); *B65H 2511/214* (2013.01); *B65H 2511/51* (2013.01);
(Continued)

(58) Field of Classification Search
CPC ..... G03G 15/6573
USPC ..... 399/405
See application file for complete search history.

(56) References Cited

U.S. PATENT DOCUMENTS 6,408,147 B1 * 6/2002 Oshida ..... B65H 43/06 271/207
6,851,668 B2 * 2/2005 Mui ..... B41J 11/0075 162/269
(Continued)

FOREIGN PATENT DOCUMENTS

JP 2004-099293 A 4/2004
JP 2006-021903 A 1/2006
(Continued)

*Primary Examiner* — Anthony H Nguyen
(74) *Attorney, Agent, or Firm* — Banner & Witcoff, Ltd.

(57) ABSTRACT

An image forming apparatus includes a tray; a casing having a first outlet, a second outlet above the first outlet, a first path, and a second path; a stack lever; a drive source; and a controller. The second path communicates with the second outlet such that a sheet conveyed along the second path is partially discharged from the second outlet and is reversed along the second path. The first outlet communicates with the first path such that the sheet conveyed along the first path is discharged from the first outlet onto the tray. The stack lever is movable between a first position where the stack lever presses a sheet on the tray and a second position higher than the first position. The controller is configured to control the drive source such that, when the sheet is discharged from the second outlet, the stack lever is at the second position.

10 Claims, 5 Drawing Sheets

(51) Int. Cl.

| | |
|---|---|
| ***B65H 29/52*** | (2006.01) |
| ***B65H 31/26*** | (2006.01) |
| ***B65H 43/02*** | (2006.01) |
| ***B65H 85/00*** | (2006.01) |
| *B65H 31/24* | (2006.01) |

(52) U.S. Cl.
CPC .. *B65H 2511/515* (2013.01); *B65H 2513/412* (2013.01); *B65H 2513/53* (2013.01); *B65H 2553/612* (2013.01); *B65H 2555/13* (2013.01); *B65H 2555/20* (2013.01); *B65H 2601/521* (2013.01); *G03G 15/206* (2013.01); *G03G 15/2053* (2013.01)

(56) References Cited

U.S. PATENT DOCUMENTS

| | | | | |
|---|---|---|---|---|
| 7,107,004 | B2 * | 9/2006 | Saito | G03G 15/6573 399/405 |
| 8,023,837 | B2 * | 9/2011 | Nishitani | G03G 15/6552 271/152 |
| 8,200,145 | B2 * | 6/2012 | Kondo | G03G 15/6576 271/220 |
| 8,682,240 | B2 * | 3/2014 | Fukita | G03G 15/6573 271/211 |
| 2003/0193125 | A1 * | 10/2003 | Saegusa | B65H 31/00 270/58.08 |
| 2004/0052563 | A1 | 3/2004 | Hayamizu et al. | |
| 2006/0244208 | A1 * | 11/2006 | Kubota | B65H 31/22 271/207 |
| 2007/0177916 | A1 * | 8/2007 | Ninomiya | G03G 15/235 399/405 |
| 2009/0108518 | A1 * | 4/2009 | Kawashima | B65H 5/36 271/225 |
| 2016/0209797 | A1 | 7/2016 | Torii et al. | |

FOREIGN PATENT DOCUMENTS

| | | | |
|---|---|---|---|
| JP | 2007-039150 | A | 2/2007 |
| JP | 2014-240314 | A | 12/2014 |
| JP | 2015-093778 | A | 5/2015 |
| JP | 2016-132547 | A | 7/2016 |

* cited by examiner

IMAGE FORMING APPARATUS

CROSS-REFERENCE TO RELATED APPLICATION

This application claims priority from Japanese Patent Application No. 2016-189787 filed on Sep. 28, 2016, the content of which is incorporated herein by reference in its entirety.

FIELD OF DISCLOSURE

The present disclosure relates to an image forming apparatus such as a printer or a copying machine.

BACKGROUND

There has hitherto been known an image forming apparatus capable of duplex printing for forming images on both surfaces of a sheet.

It has been proposed that, in this type of image forming apparatus, a duplex (DX) outlet for switching back sheets should be provided separately from an outlet through which sheets are discharged onto a sheet discharge tray. In simplex printing for forming an image on one surface of a sheet, after an image is formed on one of the surfaces of a sheet in an image forming device, the sheet is discharged onto the sheet discharge tray through the outlet. In duplex printing, after an image is formed on one surface of a sheet in the image forming device, the sheet is sent out from the DX outlet toward the sheet discharge tray, and the conveying direction of the sheet is reversed (switched back) in a state in which a trailing edge of the sheet remains in the apparatus. The sheet, of which conveying direction is switched back, is conveyed through a reverse conveying path and is sent into the image forming device with front and back surfaces thereof inverted, and an image is formed on the other surface of the sheet in the image forming device. After the images are formed on both surfaces of the sheet, the sheet is discharged onto the sheet discharge tray through the outlet.

In such a structure, when the sheet is sent out from the DX outlet toward the sheet discharge tray, it sometimes contacts another sheet, for example, stacked on the sheet discharge tray or being discharged from the outlet. If the sheet discharged from the DX outlet contacts the other sheet, it is sometimes buckled, or the other sheet is sometimes electrostatically attracted to the sheet. This causes a jam and double feeding.

SUMMARY

Accordingly, it is an object of the present disclosure to provide an image forming apparatus including a first outlet through which a sheet is discharged to a tray and a second outlet through which a sheet to be switched back is temporarily discharged, and configured so that the sheet discharged from the second outlet rarely contacts other sheets.

According to an aspect of the disclosure, an image forming apparatus includes a tray, a casing having a first outlet, a second outlet, a first path, and a second path, a stack lever, a drive source, and a controller. The second path communicates with the second outlet such that a sheet conveyed along the second path is partially discharged from the second outlet and is reversed along the second path. The first outlet communicates with the first path such that the sheet conveyed along the first path is discharged from the first outlet onto the tray. The second outlet is above the first outlet. The stack lever is supported by the casing and disposed downstream of the first outlet in a sheet discharge direction. The stack lever is movable between a first position where the stack lever presses a sheet on the tray and a second position higher than the first position. The drive source is configured to cause the stack lever to move between the first position and the second position. The controller is configured to control the drive source such that, when the sheet is discharged from the second outlet, the stack lever is at the second position.

With this structure, a sheet discharged from the second outlet rarely contacts other sheets, it can be prevented from being buckled. Moreover, the state of the sheet discharged on the tray can be maintained.

DETAILED DESCRIPTION

An embodiment of the present disclosure will be described in detail below with reference to the attached drawings.

[Overall Configuration]

Figure 1:
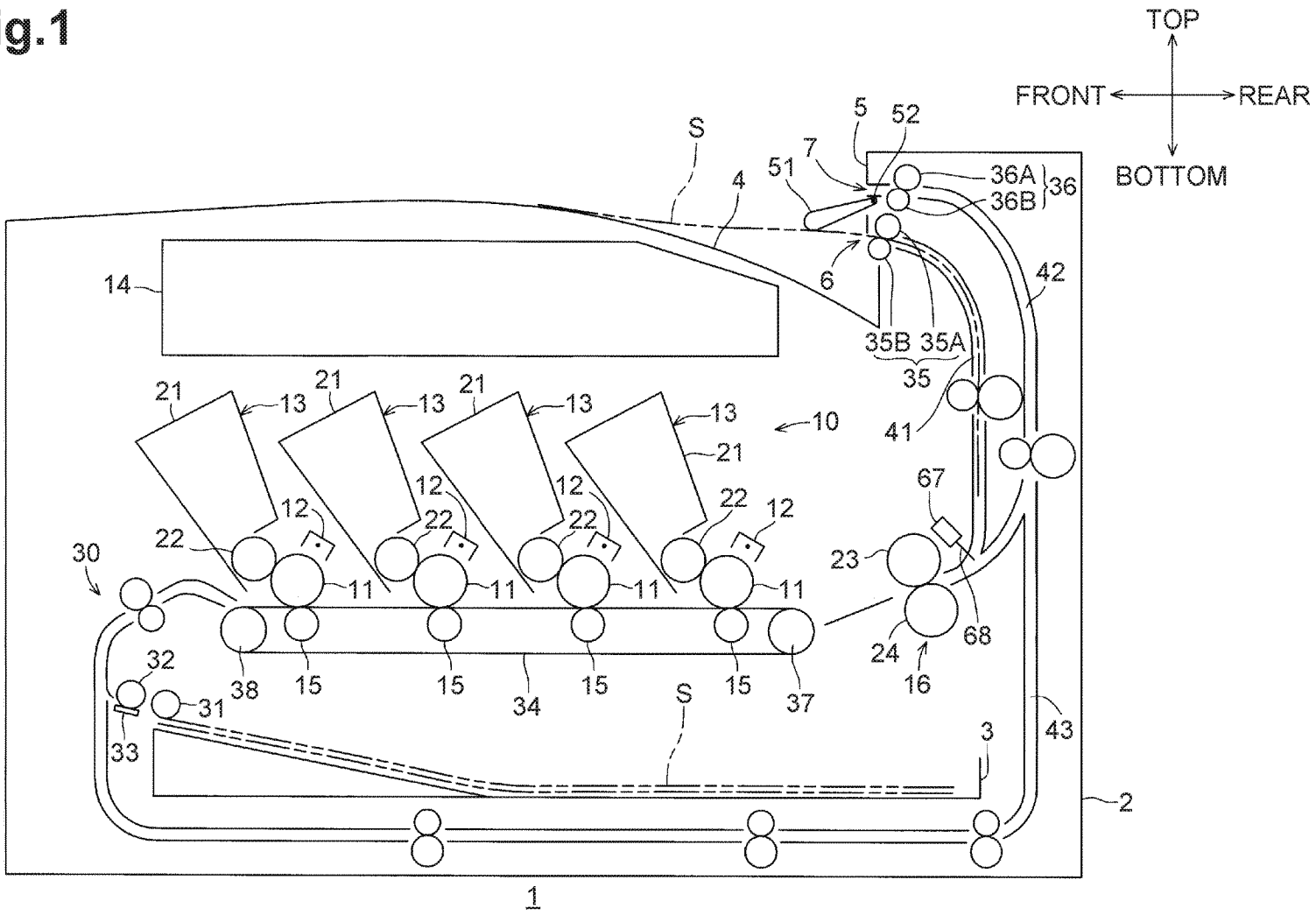
FIG. 1 is a cross-sectional view of a laser printer according to an embodiment of the present disclosure.

A laser printer 1 (an example of an image forming apparatus) illustrated in FIG. 1 includes a housing 2 nearly shaped like a rectangular parallelepiped.

In the following description, a direction perpendicular to the paper plane of FIG. 1 is taken as a width direction of the laser printer 1, and a front side and a depth side of the paper plane are defined as "left side" and "right side" of the laser printer 1, respectively. With reference to a state in which the laser printer 1 is viewed so that a left side surface and a right side surface thereof are on the "left side" and the "right side", "front side", "rear side", "upper side", and "lower side" of the laser printer 1 are defined. In FIGS. 1, 2, 3A, and 3B, the directions thus defined are shown by arrows.

A feed tray 3 is provided in a bottom part of the housing 2. The feed tray 3 is configured to support a plurality of sheets S in a stacked state.

On an upper surface of the housing 2, a sheet discharge tray 4 (an example of a tray) is provided as a part of the upper surface of the housing 2. The sheet discharge tray 4 extends rearward from a front end of the upper surface of the housing 2. A rear part of the sheet discharge tray 4 is inclined downward as it extends toward the rear side.

The housing 2 also has a wall surface 5 extending upward from a rear end of the sheet discharge tray 4. The wall surface 5 has a first outlet 6 through which a sheet S is discharged onto the sheet discharge tray 4. The first outlet 6 is spaced above the rear end of the sheet discharge tray 4. The wall surface 5 further has a second outlet 7 through which a sheet S is temporarily discharged when the conveying direction of the sheet S is reversed. The second outlet 7 is spaced above the first outlet 6.

Inside the housing 2, an electrophotographic image forming device 10 is provided to form an image on a sheet S. The image forming device 10 includes four photosensitive drums 11, four charging devices 12, four developing devices 13, an exposing device 14, four transfer rollers 15, and a fixing device 16.

The four photosensitive drums 11 are provided, respectively, for colors of black (K), yellow (Y), magenta (M), and cyan (C). Above the feed tray 3, the photosensitive drums 11 are arranged in parallel at an equal interval in the front-rear direction in the order of black, yellow, magenta, and cyan from the front side. Each of the photosensitive drums 11 is rotatable on a rotation axis extending in the right-left direction (width direction).

The four charging devices 12 are disposed facing upper rear sides of the corresponding photosensitive drums 11. For example, the charging devices 12 are scorotron charging devices each including a wire and a grid.

The four developing devices 13 are disposed facing front upper sides of the corresponding photosensitive drums 11. Each of the developing devices 13 includes a developing housing 21 that contains toner and a developing roller 22 held in the developing housing 21. The developing roller 22 is rotatable on a rotation axis extending in the right-left direction. A peripheral surface of the developing roller 22 is in contact with a peripheral surface of the corresponding photosensitive drum 11.

The exposing device 14 is disposed above the photosensitive drums 11, the charging devices 12, and the developing devices 13. The exposing device 14 includes a laser beam source and an optical system composed of, for example, a laser and a polygonal mirror, and emits a laser beam based on image data toward the peripheral surfaces of the photosensitive drums 11.

The four transfer rollers 15 are disposed below the corresponding photosensitive drums 11. Each of the transfer rollers 15 is rotatable on an axis extending in the width direction.

The fixing device 16 is disposed at the rear of the rearmost photosensitive drum 11. The fixing device 16 includes a heat roller 23 and a pressure roller 24. The heat roller 23 is rotatable on an axis extending in the width direction. The pressure roller 24 is disposed diagonally below and to the rear of the heat roller 23, and is rotatable on an axis extending in the width direction. Peripheral surfaces of the heat roller 23 and the pressure roller 24 are in contact with each other.

Inside the housing 2, a conveying device 30 is provided to convey sheets S. The conveying device 30 includes a feed roller 31, a separation roller 32, a separation pad 33, a conveying belt 34, a first sheet discharge roller set 35, and a second sheet discharge roller set 36.

The feed roller 31 is disposed above a front end portion of the feed tray 3. A peripheral surface of the feed roller 31 is in contact with an upper surface of the uppermost sheet S supported on the feed tray 3.

The separation roller 32 and the separation pad 33 are disposed in front of the feed roller 31. The separation roller 32 is rotatable on an axis extending in the width direction. A peripheral surface of the separation roller 32 is in contact with the separation pad 33 from above.

The conveying belt 34 is disposed below the four photosensitive drums 11. The conveying belt 34 is an endless belt wound around two rollers 37 and 38. The two rollers 37 and 38 are disposed at the same position in the up-down direction, and are disposed with a space therebetween in the front-rear direction. Thus, the conveying belt 34 has upper and lower flat portions extending in the front-rear direction and the right-left direction between the two rollers 37 and 38. The upper flat portion extends between the four photosensitive drums 11 and the four transfer rollers 15 and is in contact with the peripheral surfaces of the photosensitive drums 11 and the transfer rollers 15.

The first sheet discharge roller set 35 is disposed at the rear of the first outlet 6. The first sheet discharge roller set 35 is composed of a pair of rollers, that is, a driving roller 35A and a driven roller 35B. The driving roller 35A and the driven roller 35B are rotatable on their axes extending in the width direction with the peripheral surfaces thereof in contact with each other. A contact portion between the peripheral surfaces of the driving roller 35A and the driven roller 35B faces the first outlet 6 from the rear.

The second sheet discharge roller set 36 is disposed at the rear of the second outlet 7. The second sheet discharge roller set 36 is composed of a pair of rollers, that is, a driving roller 36A and a driven roller 36B. The driving roller 36A and the driven roller 36B are rotatable on their axes extending in the width direction with peripheral surfaces thereof in contact with each other. A contact portion between the peripheral surfaces of the driving roller 36A and the driven roller 36B faces the second outlet 7 from the rear.

In printing (image formation) on a sheet S, the image forming device 10 carries out an image forming operation, and the conveying device 30 conveys the sheet S.

To feed out a sheet S from the feed tray 3, the feed roller 31 rotates clockwise, when viewed from the right. By the rotation of the feed roller 31, a sheet S in contact with the peripheral surface of the feed roller 31 (i.e., the uppermost sheet S of the sheets S supported on the feed tray 3) is fed frontward. The sheet S fed from the feed tray 3 is then separated from the other sheets S when the fed sheet S passes between the separation roller 32 and the separation pad 33.

After passing between the separation roller 32 and the separation pad 33, the sheet S is sent onto the conveying belt 34. The conveying belt 34 moves around in the clockwise direction, when viewed from the right. The sheet S sent on the conveying belt 34 moves together with the upper flat portion of the conveying belt 34, and passes in order between the photosensitive drums 11 and the conveying belt 34.

The photosensitive drums 11 rotate counterclockwise, when viewed from the right. Along with the rotation of the photosensitive drums 11, the surfaces of the photosensitive drums 11 are uniformly charged by the charging devices 12, and are then selectively exposed by a laser beam from the exposing device 14. By this exposure, electrostatic charges are selectively removed from the surfaces of the photosensitive drums 11, and electrostatic latent images are formed on the surfaces of the photosensitive drums 11. A developing bias is applied to the developing roller 22 in each of the developing devices 13. When an electrostatic latent image faces the developing roller 22, toner is supplied from the developing roller 22 to the electrostatic latent image due to a potential difference between the electrostatic latent image and the developing roller 22. The electrostatic latent image on each of the surfaces of the photosensitive drums 11 is thereby developed into a toner image.

A transfer bias is supplied to the transfer rollers 15. When a monochromatic image is to be formed on a sheet S, a toner image is formed on the surface of the black photosensitive drum 11. The toner image is transferred onto the sheet S passing between the black photosensitive drum 11 and the conveying belt 34 by the action of the transfer bias. When a color image is to be formed on a sheet S, toner images are formed on the surfaces of two or more photosensitive drums 11. These toner images are superimposed and transferred onto the sheet S passing between the photosensitive drums 11 and the conveying belt 34 by the action of the transfer bias.

The sheet S on which the toner image is transferred is conveyed to the fixing device 16. In the fixing device 16, the sheet S passes between the heat roller 23 and the pressure roller 24. At this time, the toner image is fixed on the sheet S by heat and pressure. Thus, image formation on one side of the sheet S is achieved.

In the laser printer 1, simplex printing for forming an image on only a first surface of a sheet S and duplex printing for forming images on both the first surface and a second surface of the sheet S can be performed. To enable simplex printing and duplex printing, a first conveying path 41, a second conveying path 42, and a reverse conveying path 43 are provided inside the housing 2. The first conveying path 41 is provided as a space that extends from the feed tray 3, passes between the separation roller 32 and the separation pad 33, between the photosensitive drums 11 and the conveying belt 34, between the heat roller 23 and the pressure roller 24 in the fixing device 16, and between the driving roller 35A and the driven roller 35B in the first sheet discharge roller set 35 in order, and reaches the first outlet 6. The second conveying path 42 is provided as a space that branches from the first conveying path 41 between the fixing device 16 and the first sheet discharge roller set 35, passes between the driving roller 36A and the driven roller 36B in the second sheet discharge roller 36, and reaches the second outlet 7. The reverse conveying path 43 branches from a middle portion of the second conveying path 42, extends downward at a rear end portion of the housing 2, extends then frontward below the feed tray 3, and is connected to the first conveying path 41 between the separation roller 32 and the conveying belt 34.

In simplex printing, a sheet S with an image formed on a first surface is conveyed along the first conveying path 41, and is discharged onto the sheet discharge tray 4 through the first outlet 6 by the first sheet discharge roller set 35.

In duplex printing, after an image is formed on a first surface of a sheet S, the sheet S is conveyed along the second conveying path 42, and the conveying direction of the sheet S being conveyed toward the sheet discharge tray 4 is switched back (reversed) by the second sheet discharge roller 36. During this switch-back operation, an upstream end portion of the sheet S in the conveying direction is nipped by the driving roller 36A and the driven roller 36B in the second sheet discharge roller set 36, and a portion of the sheet S downstream from the upstream end portion in the conveying direction is discharged from the second outlet 7 toward the sheet discharge tray 4. The switched-back sheet S is sent from the second conveying path 42 into the reverse conveying path 43, is conveyed along the reverse conveying path 43, and is sent from the reverse conveying path 43 into the first conveying path 41. By being conveyed along the reverse conveying path 43, the sheet S is inverted, and is conveyed along the first conveying path 41 with a second surface with no image facing the photosensitive drums 11. Then, an image is formed on the second surface of the sheet S, and image formation on both surfaces of the sheet S is achieved. The sheet S having the images on both surfaces is conveyed along the first conveying path 41, and is discharged onto the sheet discharge tray 4 through the first outlet 6 by the first sheet discharge roller set 35.

[Stack Lever]

Figure 2:
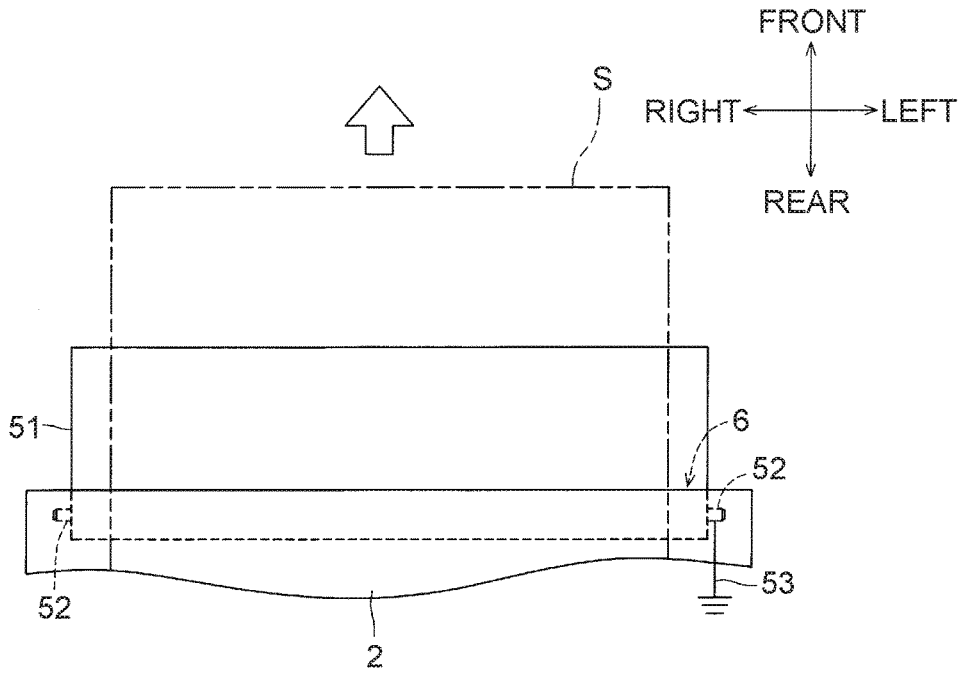
FIG. 2 is a plan view illustrating a section near a stack lever provided in the laser printer.

The laser printer 1 includes a stack lever 51. The stack lever 51 is integrally molded from resin having electrical conductivity, and is shaped like a substantially rectangular plate-like member that is long in the width direction (right-left direction) in plan view, as illustrated in FIG. 2. The stack lever 51 has a width greater than the maximum width of a sheet S to be discharged from the first outlet 6.

The stack lever 51A has a shaft portion 52 at a proximal or rear end portion of the stack lever 51A, the shaft portion 52 protruding to the right and left. The shaft portion 52 is held by the housing 2 between the first outlet 6 and the second outlet 7, and the stack lever 51 extends frontward from the wall surface 5 of the housing 2 toward the sheet discharge tray 4, that is, toward the downstream side in the discharge direction of the sheet S from the first outlet 6.

Figure 3A:
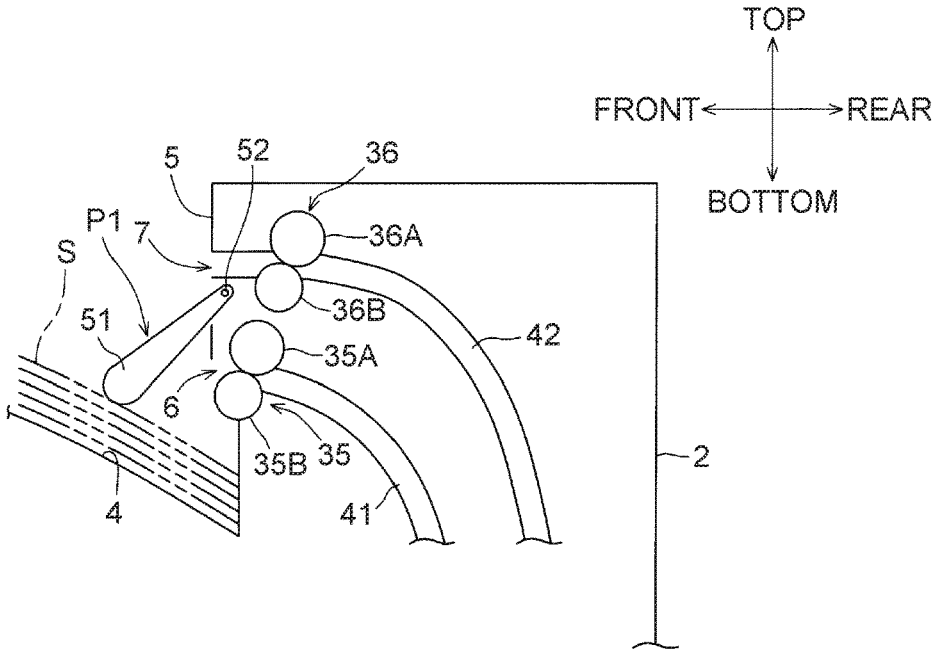
FIG. 3A is a cross-sectional view illustrating a section near the stack lever at a first position.
Figure 3B:
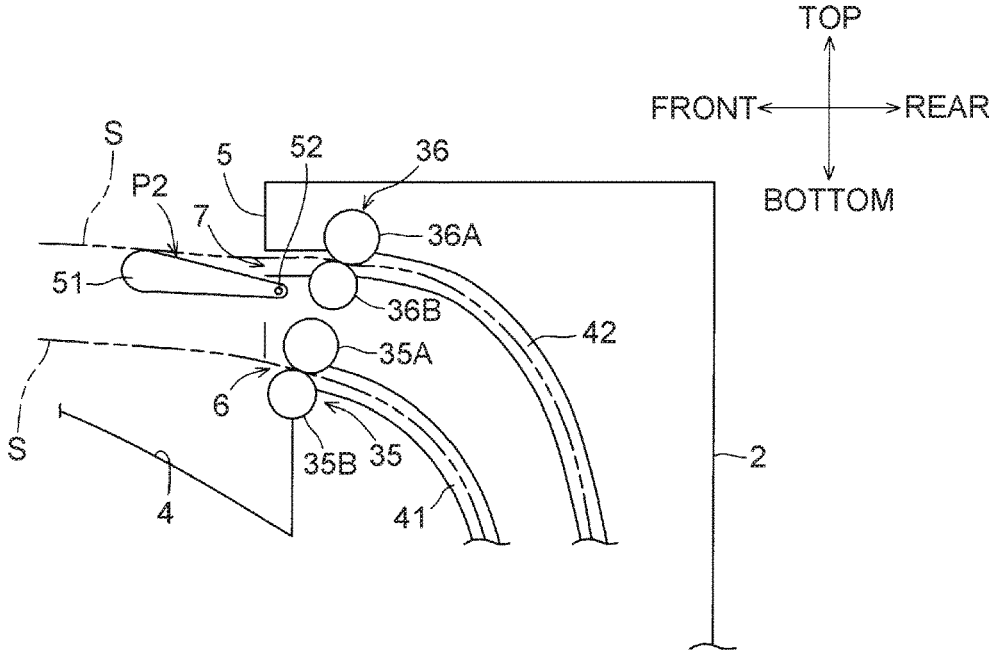
FIG. 3B is a cross-sectional view illustrating a section near the stack lever at a second position.

The shaft portion 52 of the stack lever 51 is rotatably held by the housing 2. Thus, the stack lever 51 is movable between a first position P1 where a distal end portion of the stack lever 51 is located below the first outlet 6 to hold sheets S discharged on the sheet discharge tray 4 from above, as illustrated in FIG. 3A, and a second position P2, which is higher than the first position P1, and where the distal end portion of the stack lever 51 is located at almost the same height as the second outlet 7, as illustrated in FIG. 3B.

Further, the shaft portion 52 is connected to a ground through a ground line 53.

[Electric Configuration]

Figure 4:
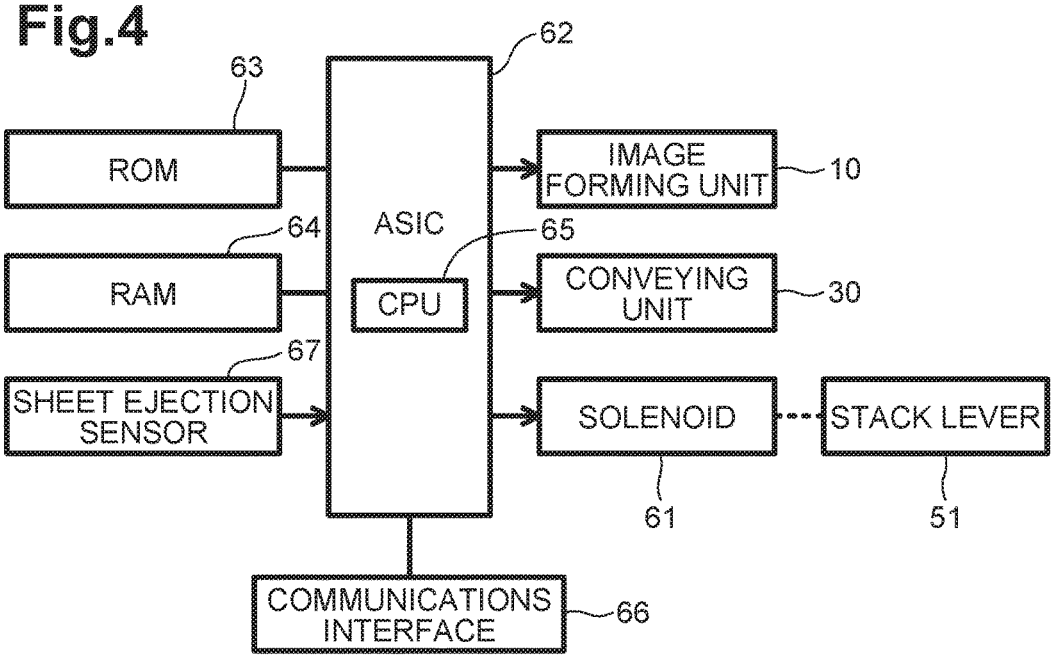
FIG. 4 is a block diagram showing an electric configuration of the laser printer.

As illustrated in FIG. 4, the laser printer 1 includes a solenoid 61 (an example of a driving source). A plunger of the solenoid 61 is electrically coupled to the stack lever 51. When the solenoid 61 is in a de-energized state (off), the stack lever 51 is located at the first position P1 by its own weight. When the solenoid 61 is turned into an energized state (on), the plunger of the solenoid 61 is pulled into a main body of the solenoid 61, and the stack lever 51 rotates from the first position P1 to the second position P2 by the movement of the plunger.

The laser printer 1 further includes an application specific integrated circuit (ASIC) 62, a ROM 63, and a RAM 64. A CPU 65 (an example of a controller) is included in the ASIC 62.

A communications interface 66 is electrically coupled to the ASIC 62. The communications interface 66 is an interface for communication with an external apparatus such as a personal computer (PC) connected to a local area network (LAN). The communication method may be either a wireless communication method or a wired communication method. For example, image data received from the external apparatus through the communications interface 66 is input to the ASIC 62.

A sheet discharge sensor 67 (an example of a sensor) is electrically coupled to the ASIC 62. As illustrated in FIG. 1, the sheet discharge sensor 67 is disposed downstream of the fixing device 16 in the conveying direction of the sheets S. The sheet discharge sensor 67 is provided with an actuator 68. The actuator 68 is located on the upstream side in the conveying direction of a branch point of the first conveying path 41 from the second conveying path 42. While a sheet S is conveyed along the first conveying path 41 and a leading edge of the sheet S presses the actuator 68, an ON signal (a high-level signal) is output from the sheet discharge sensor 67. When the sheet S passes and separates from the actuator 68 and the actuator 68 returns to the initial position, an OFF signal (a low-level signal) is output from the sheet discharge sensor 67.

Therefore, the CPU 65 in the ASIC 62 senses the passage of the sheet S at the actuator 68 of the sheet discharge sensor 67 on the basis of a change in the output signal from the sheet discharge sensor 67.

Then, the CPU 65 executes programs for various processing operations to control the operations of the image forming device 10, the conveying device 30, and the solenoid 61.

The ROM 63 stores the programs to be executed by the CPU 65 and various data.

The RAM 64 is used as a work area when the CPU 65 executes the programs.

The sheet discharge sensor 67 may output an ON signal (high-level signal) in a state before the actuator 68 is pressed by the sheet S and output an OFF signal (low-level signal) in a state in which the actuator 68 is pressed by the sheet S.

[Stack-Lever Position Control]

Figure 5:
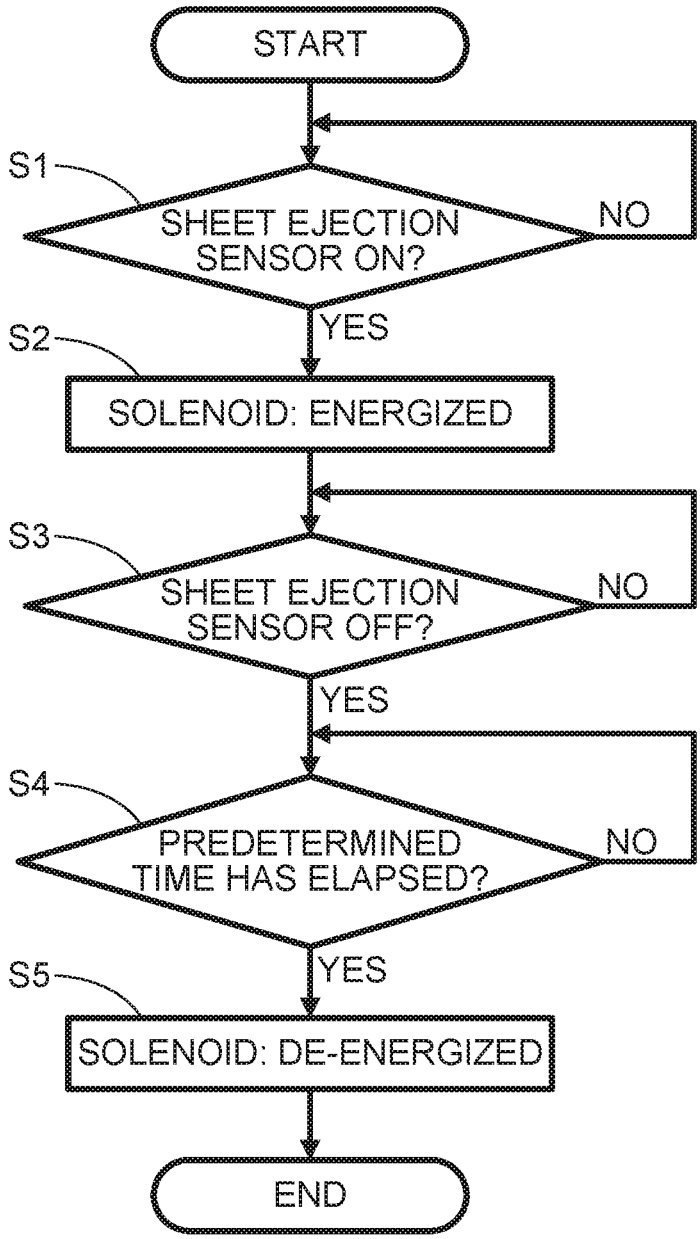
FIG. 5 is a flowchart showing the flow of control for changing the position of the stack lever.

During a printing operation for forming an image on a sheet S (image forming operation), the CPU 65 of the ASIC 62 performs a stack lever position control for changing a position of the stack lever 51 shown in FIG. 5.

In the stack-lever position control, the CPU 65 determines whether an output signal from the sheet discharge sensor 67 is an ON signal (S1).

While the sheet discharge sensor 67 is outputting an OFF signal (S1: NO), the CPU 65 keeps the solenoid 61 in a de-energized state. Thus, the stack lever 51 is located at the first position P1.

When the sheet discharge sensor 67 is switched from the OFF state to the ON state (S1: YES), the CPU 65 switches the solenoid 61 from the de-energized state to an energized state (S2). Thus, the stack lever 51 rotates from the first position P1 to the second position P2.

In this way, when the sheet S reaches the position of the actuator 68 of the sheet discharge sensor 67, the leading edge of the sheet S passes the position of the actuator 68, and the sheet discharge sensor 67 is turned on, the stack lever 51 rotates from the first position P1 to the second position P2, regardless of whether the sheet S is discharged onto the sheet discharge tray 4 through the first outlet 6 or is temporarily discharged from the second outlet 7 and is switched back.

After that, when the sheet S is further conveyed, the trailing edge of the sheet S separates from the actuator 68 of the sheet discharge sensor 67, and the sheet discharge sensor 67 is switched from the ON state to the OFF state (S3: YES), the CPU 65 starts a timer and starts to measure the time that has elapsed since the sheet discharge sensor 67 is switched from the ON state to the OFF state.

When a predetermined time has elapsed from the time when the sheet discharge sensor 67 is switched from the ON state to the OFF state (S4: YES), the CPU 65 switches the solenoid 61 from the energized state to a de-energized state (S5). Thus, the stack lever 51 rotates from the second position P2 to the first position P1. For example, the predetermined time is set at a time more than or equal to a time required from when the trailing edge of the sheet S separates from the actuator 68 to when the trailing edge passes the first sheet discharge roller set 35. Thus, when the sheet S is discharged from the first outlet 6, the sheet S reaches the sheet discharge tray 4, and then the stack lever 51 rotates from the second position P2 to the first position P1.

[Operational Effects]

As described above, the housing 2 has the first outlet 6 from which the sheet S conveyed along the first conveying path 41 is discharged onto the sheet discharge tray 4. The housing 2 also has, above the first outlet 6, the second outlet 7 from which the sheet S conveyed along the second conveying path 42 is temporarily discharged for reversing the conveying direction.

The stack lever 51 is disposed downstream of the first outlet 6 in the discharge direction of the sheet S. The stack lever 51 is located at the first position P1 or the second position P2 located above the first position P1, depending on whether the solenoid 61 is energized or de-energized.

When the sheet S is discharged from the second outlet 7, the stack lever 51 is located at the second position P2 by energizing the solenoid 61 before the leading edge of the sheet S passes through the second outlet 7. Thus, a leading portion of the sheet S being temporarily discharged from the second outlet 7 is supported by the stack lever 51 located at the second position P2. This reduces the leading portion of the sheet S from hanging down, and the leading edge of the sheet S rarely contacts other sheets, for example, already discharged and stacked on the sheet discharge tray 4. As a result, the leading portion of the sheet S discharged from the second outlet 7 is reduced from being buckled. Further, other sheets S can be reduced from being electrostatically attracted to the sheet S being discharged from the second outlet 7 or being switched back from the second outlet 7. This can maintain the state of the sheet S discharged onto the sheet discharge tray 4.

If the stack lever 51 is located at the first position P1 when a sheet S is discharged from the first outlet 6, the leading portion of the sheet S discharged from the first outlet 6 may be buckled by contact with the stack lever 51, or the leading edge of the sheet S in contact with the stack lever 51 may face downward and touch other sheets S, for example, already discharged and stacked onto the sheet discharge tray 4. According to this embodiment, since the solenoid 61 is energized at the predetermined time (S2), the stack lever 51 rotates from the first position P1 to the second position P2 before the leading edge of the sheet S passes through the first outlet 6. Since the stack lever 51 is located at the second position P2, the sheet S discharged from the first outlet 6 passes below the stack lever 51. That is, the stack lever 51 does not hinder discharge of the sheet S from the first outlet 6.

When the predetermined time elapses after the solenoid 61 is energized, that is, when power supply to the solenoid 61 is stopped (S5) after the sheet S is discharged from the first outlet 6, the stack lever 51 moves from the second position P2 to the first position P1 by its own weight. The stack lever 51 at the first position P1 holds the sheet S discharged on the sheet discharge tray 4 from above. Since the stack lever 51 presses the sheet S on the sheet discharge tray 4, curl of the sheet S can be removed.

The stack lever 51 has a width greater than the maximum width of a sheet S to be discharged from the first outlet 6. For this reason, the stack lever 51 can hold the sheet S discharged on the sheet discharge tray 4 from above all over the width. As a result, curl of the sheet S can be more properly removed. Further, the stack lever 51 also functions as a sound barrier against operation sound leaking from the inside of the housing 2 through the first outlet 6.

The stack lever 51 is made of resin having electrical conductivity, and is connected to the ground through the ground line 53. Thus, since the potential of the stack lever 51 is totally equal to the ground potential, when the sheet S discharged from the first outlet 6 contacts the stack lever 51, static electricity accumulated on the sheet S flows to the ground line 53 via the stack lever 51, and is eliminated from the sheet S. Also, when the stack lever 51 supports the sheet S temporarily discharged from the second outlet 7, static electricity accumulated on the sheet S flows to the ground line 53 via the stack lever 51, and can be eliminated from the sheet S. Further, when the stack lever 51 comes into contact with a sheet S already discharged and stacked on the sheet discharge tray 4, static electricity can be eliminated from the stacked sheet S. As a result, the sheet S already stacked on the sheet discharge tray 4 can be reduced from moving while being electrostatically attracted to a sheet S being discharged from the first outlet 6 or the second outlet 7.

In the laser printer 1, the sheet discharge sensor 67 is provided downstream of the fixing device 16 in the conveying direction of the sheet S, and energization/de-energization of the solenoid 61 is controlled based on the output signal from the sheet discharge sensor 67. Thus, the stack lever 51 can be located at the second position P2 before the leading edge of the sheet S reaches the first outlet 6 or the second outlet 7, and the stack lever 51 can be located at the first position P1 after the sheet S is discharged from the first outlet 6 onto the sheet discharge tray 4.

[Modifications]

While the embodiment of the present disclosure has been described above, the present disclosure can also be carried out by other embodiments.

For example, while the stack lever 51 is made of resin having electrical conductivity, the structure of the stack lever 51 is not limited thereto. For example, the stack lever may constitute an insulating body. In this case, an upper surface and a distal end portion of the stack lever may be covered with an electrically conductive film, which is grounded. Static electricity accumulated on a sheet S can be eliminated from a sheet S when the sheet S contacts the film.

The stack lever may have a plurality of small holes. According to this structure, heat exhausted from the inside of the housing 2 through the first outlet 6 can be released through the small holes, which may improve the heat exhaust property. Further, while the above embodiment illustrates that the stack lever 51 is a substantially rectangular plate-like member that is longer than the sheet S in the width direction, the structure is not limited thereto as long as the stack lever 51 can support the sheet S. For example, a plurality of levers may be arranged in the width direction.

It is only required that a free end of the stack lever 51 should be located downstream of the first outlet 6 when the stack lever 51 is at the second position P2. The shaft portion 52 may be located upstream of the first outlet 6 in the sheet discharge direction.

As a driving source for moving the stack lever 51 between the first position P1 and the second position P2, a motor may be used instead of the solenoid 61.

By fixing a gear to a rotation shaft of the motor, fixing a gear to the shaft portion 52 of the stack lever 51, and transmitting power from the gear of the motor to the gear of the shaft portion 52, the stack lever 51 can be located at the first position P1 or the second position P2 in accordance with the driving of the motor.

While the color laser printer 1 is adopted in the above-described embodiment, the present disclosure may also be applied to a monochrome laser printer that can form only monochrome images. The present disclosure may also be applied to an image forming apparatus that forms images on sheets S by a method, such as an inkjet method, other than electrophotography as long as the image forming apparatus can form color images or monochromatic images according to image data.

In the above-described embodiment, the CPU 65 performs the processing operations. However, the ASIC 62 may include a plurality of CPUs and the plurality of CPUs may perform the processing operations by cooperation.

In addition, various design changes can be applied to the above-described configurations within the scope of the matters set forth in the claims.

What is claimed is:

1. An image forming apparatus comprising:

a tray;

a casing having a first outlet, a second outlet, a first path, and a second path, the second path communicating with the second outlet such that a sheet conveyed along the second path is partially discharged from the second outlet and is reversed along the second path, the first outlet communicating with the first path such that the sheet conveyed along the first path is discharged from the first outlet onto the tray, the second outlet being above the first outlet;

a stack lever supported by the casing and disposed downstream of the first outlet and the second outlet in a sheet discharge direction, the stack lever being movable between a first position where the stack lever presses a sheet on the tray and a second position higher than the first position;

a drive source configured to cause the stack lever to move between the first position and the second position; and a controller configured to control the drive source such that, when the sheet is discharged from the second outlet, the stack lever is at the second position.

2. The image forming apparatus according to claim 1, wherein the controller is configured to, before a leading end of a sheet passes through the first outlet, control the drive source to move the stack lever to the second position.

3. The image forming apparatus according to claim 1, wherein the controller is configured to, after the sheet is discharged from the first outlet, control the drive source to move the stack lever to the first position.

4. The image forming apparatus according to claim 1, wherein the stack lever possesses electrical conductivity.

5. The image forming apparatus according to claim 4, wherein the stack lever is made of electrically conductive resin, and is grounded.

6. The image forming apparatus according to claim 4, wherein the stack lever is an electrically insulating member, and wherein the stack lever includes an electrically conductive member on a surface of the stack lever, the electrically conductive member being grounded.

7. The image forming apparatus according to claim 1, wherein the stack lever has a width greater than a maximum width of a sheet to be discharged from the first outlet.

8. The image forming apparatus according to claim 1, further comprising:

an image forming device configured to form an image on a sheet electrophotographically;

a fixing device disposed at a downstream portion of the image forming device; and a sensor disposed downstream of the fixing device in a sheet conveying direction and electrically coupled to the controller, the sensor being configured to sense a sheet conveyed from the fixing device in the sheet conveying direction, wherein the controller is configured to control the drive source based on an output signal from the sensor.

9. The image forming apparatus according to claim 1, wherein the stack lever is configured to, when located at the second position, support a sheet temporarily discharged from the second outlet.

10. The image forming apparatus according to claim 1, wherein the drive source includes a solenoid.

* * * * *